US006489368B2

(12) United States Patent
Varadaraj et al.

(10) Patent No.: US 6,489,368 B2
(45) **Date of Patent: *Dec. 3, 2002**

(54) AROMATIC SULFONIC ACID DEMULSIFIER FOR CRUDE OILS

(75) Inventors: Ramesh Varadaraj, Flemington, NJ (US); Cornelius Hendrick Brons, Washington, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/803,576

(22) Filed: Mar. 9, 2001

(65) Prior Publication Data

US 2002/0161059 A1 Oct. 31, 2002

(51) Int. Cl.[7] ..... B01D 17/05

(52) U.S. Cl. ..... 516/160; 210/708; 210/748; 204/563; 204/567

(58) Field of Search ..... 516/160, 25, 909; 562/90, 91, 88, 89; 210/708, 748, 787; 204/567, 563

(56) References Cited

U.S. PATENT DOCUMENTS 5,143,594 A * 9/1992 Stephenson et al. .... 208/48 AA
5,504,063 A * 4/1996 Becker et al. ..... 134/40
6,048,904 A * 4/2000 Wiehe et al. ..... 562/88

OTHER PUBLICATIONS

Hawley's Condensed Chemical Dictionary, Eleventh Edition, Edited by N.I. Sax and R.J. Lewis,Sr. (Van Nostrand Reinhold Company, NY, NY, copyright 1987) Oct. 1989, p. 1137 and 1279 (Entry "Tetralin").*

* cited by examiner

*Primary Examiner*—Daniel S. Metzmaier
(74) *Attorney, Agent, or Firm*—Ramesh Varadaraj

(57) ABSTRACT

The invention is directed towards a chemical demulsifier formulation comprising an alkyl aromatic sulfonic acid additive with at least 16 carbon atom alkyl group and at least two 6 carbon-ring aromatic group and a co-additive selected from the group consisting of dipropylene monobutyl ether, isoparaffinic solvent, cycloparaffinic solvent, diethylene glycol monobutyl ether, benzyl alcohol, and mixtures thereof.

8 Claims, No Drawings

AROMATIC SULFONIC ACID DEMULSIFIER FOR CRUDE OILS

FIELD OF THE INVENTION

The invention is related to crude oil demulsification and aromatic sulfonic acid demulsifier formulations.

BACKGROUND OF THE INVENTION

Produced crude oils contain varying amounts of water and inorganic salts like chlorides, sulfates and carbonates of Group Group I and Group II elements. The presence of salts present difficulties during crude oil processing such as corrosion of the oil processing equipment. In order to mitigate the effects of corrosion resulting from the presence of salts, it is advantageous to reduce the salt concentration to the range of 3 to 5 ppm by weight of the crude oil. This concentration corresponds to approximately 2 pounds of inorganic salts per 1,000 barrels of crude oil. One method to remove salts from a crude oil is to solubilize the salts in water and remove the water from the crude oil. Generally the water present in crude oil is either phase separated water or emulsified water. Emulsified water is water that is dispersed in oil as a water-in-oil emulsion. Demulsification is the method of removing the dispersed water from the oil. Generally when crude oil is produced from subterranean environments, salts like chlorides, sulfates and carbonates of Group I and Group II elements are dissolved in the water phase. Water with dissolved salts is generally called brine. Demulsification results in removal of water and a reduction in salt concentration. The value of crude oil is enhanced by reducing the levels of salts and water in the crude oil.

Among the crude oil demulsification methods in use today, electrostatic demulsification, gravity separation, centrifugation and hydrocyclone-assisted separation are frequently used. Wash water is added until the crude oils water content is in the range of 4 to 15 vol. %, and a chemical demulsifier formulation is added so that the oil and the aqueous phases can be separated by separation methods known in the art. As used herein, a crude oil emulsion is a mixture of crude oil and a suspended aqueous phase, which may be in the form of droplets stabilized by naturally occurring surface-active compounds in the crude oil. Additionally, inorganic solids such as clay or silica can also contribute to emulsion stabilization In electrostatic separation, dispersed brine droplets coalesce in between electrodes located in the oil phase. The coalesced aqueous droplets then settle below the oleaginous crude oil phase. The separation can occur in a separator where effluent brine can be removed. Treated crude is removed from the upper part of the separator. Intermediate between the oil phase and the brine phase is a "rag" layer comprising a stable emulsion and solids. The rag layer may remain in the demulsifier vessel or it may be removed therefrom for storage or further processing.

Effective demulsification requires addition of a chemical demulsifier additive to the wash water or to the crude prior to application of an electrostatic field or centrifugal force to the crude oil emulsion. Crude oils that contain high amounts of asphaltenes and naphthenic acids are generally called heavy crude oils and are difficult to demulsify. These crude oils require specifically tailored demulsifier additives for demulsification to be effective. Many demulsifier additives have phenolic groups in their chemical structure. In some cases, crude oil demulsifier additives that do not contain phenolic groups and are effective on crude oils containing asphaltenes and naphthenic acids are desired.

SUMMARY OF THE INVENTION

In one embodiment, the invention is a crude oil demulsifier formulation comprising:

about 10 wt. % to about 80 wt. % based on the weight of the chemical demulsifier formulation of an additive having the formula:

$$R—Ar—SO_3H$$

where R is an alkyl group containing at least 16 carbons and at least one branch of an alkyl group, Ar is an aromatic group with at least two 6-ring aromatic groups and about 90 wt. % to about 20 wt. % based on the weight of the chemical demulsifier formulation of a co-additive selected from the group consisting of dipropylene monobutyl ether, aromatic naphtha, isoparaffinic solvent, cycloparaffinic solvent, aromatic solvent, diethylene glycol monobutyl ether, benzyl alcohol, and mixtures thereof.

In another embodiment, the invention is a process to demulsify a crude oil emulsion comprising:

adding to a crude oil emulsion a chemical demulsifier formulation comprising:

about 10 wt. % to about 80 wt. % based on the weight of the chemical demulsifier formulation of an additive having the formula:

$$R—Ar—SO_3H$$

where R is an alkyl group containing at least 16 carbons and at least one branch of an alkyl group, Ar is an aromatic group with at least two 6-ring aromatic groups and about 90 wt. % to about 20 wt. % based on the weight of the chemical demulsifier formulation of a co-additive selected from the group consisting of dipropylene monobutyl ether, aromatic naphtha, isoparaffinic solvent, cycloparaffinic solvent, aromatic solvent, diethylene glycol monobutyl ether, benzyl alcohol, and mixtures thereof.

separating said emulsion into a plurality of layers, and optionally, recovering demulsified crude oil.

DETAILED DESCRIPTION OF THE INVENTION

Applicants' discoveries are based on the fact that adding a chemical demulsifier formulation can enhance brine droplet coalescence in crude oil. The chemical additive in the formulation is a branched aromatic sulfonic acid of a certain structure. Application of electrostatic fields, centrifugation or hydrocyclone treatment enhances the process of coalescence of dispersed brine droplets. For a chemical demulsifier additive which, itself, is an acid to be effective as a demulsifier of an acid containing crude oil is unexpected because acids are known to those skilled in the art to be emulsifiers.

The combination of the additive and co-additive provides a synergistic effect and enhances demulsification performance. The combination of the aromatic sulfonic acid additive and co-additive comprises the demulsifier formulation. Co-additives selected from the group consisting of dipropylene monobutyl ether, aromatic naphtha, isoparaffinic solvent, cycloparaffinic solvent, aromatic solvent, diethylene glycol monobutyl ether, benzyl alcohol, and mixtures thereof are examples where synergistic behavior can be obtained.

While the invention can be practiced with any crude oil containing brine, it is preferably practiced with heavy or waxy crude oils. Heavy or waxy crude oils have one or more of the following characteristics:

The crude oil has an API gravity ranging from about 5 to about 30.

The crude oil has a high naphthenic acid concentration; characterized by a high "TAN" number (the TAN number represents the number of milliequivalents of potassium hydroxide required to neutralize 1 gram of crude oil).

The fraction of the crude oil soluble in n-heptane ranges from about 0.5 wt. % to about 15 wt. %.

The invention can also be practiced on crude oil distillates, synthetic oils for example, silicone oils and vegetable or animal derived oils.

Chemical demulsifier additive useful in the practice of the invention has the structure:

$$R—Ar—SO_3H$$

Preferably, the chemical demulsifier additive has an alkyl group R that is at least 16 carbons. The alkyl group is preferably branched. A "Y" branched alkyl group is more preferred. The "Y" branch may have further branching. The aromatic group, Ar, has at least two 6-ring aromatic groups. Preferably the rings are fused. Cycloalkyl groups can be attached to the aromatic rings. The cycloalkyl rings have at least 6 carbons and can be fused or pendant to the aromatic rings. The $SO_3H$ group can be attached to any position on the aromatic rings. Preferably at least 1 $SO_3H$ group is present.

The chemical demulsifier additive is used in combination with a co-additive. Co-additives useful in the practice of this invention include diethylene glycol monobutyl ether, dipropylene glycol monobutyl ether, aromatic naphtha, isoparaffinic solvent, cycloparaffinic solvent, aromatic solvent, oxygenated solvents, such as diethylene monobutyl ether benzyl alcohol, and mixtures thereof. The preferred formulation comprises about 10 wt. % to about 80 wt. % chemical demulsifier additive and about 20 wt. % to about 90 wt. % diethylene glycol mono butyl ether. Particularly preferred is a formulation of about 50% chemical demulsifier additive and about 50% diethylene glycol mono butyl ether.

An effective amount of the chemical additive and co-additive mixture (demulsifier formulation) is combined with the crude oil emulsion. An effective amount of the demulsifier formulation is the amount necessary to displace the surface-active component from the brine droplets and render the brine droplets more amenable to coalescence. The effective amount ranges from about 5 ppm to about 10,000 ppm based on the weight of the crude oil, with about 20 ppm to about 40 ppm being preferred.

Adding water to the crude oil that already contains water is a process called wash water addition. Wash water addition is optional. The amount of added water required for effective demulsification could be in the range of 1 to 20 wt % based on the weight of crude oil.

In a preferred embodiment, a crude oil containing dispersed brine and a chemical demulsifier formulation are combined, wash water is added, the mixture mixed and then demulsified under electrostatic desalting or demulsification conditions. Electrostatic desalting or demulsification is known to those skilled in the art of crude oil processing. By way of example, the crude is desalted in a vessel having electrodes at potentials ranging from about 10,000 volts to about 40,000 volts, A.C. or D.C. Voltage gradients present in the vessel range from about 500 volts per inch to about 5,000 volts per inch, preferably at a potential ranging from about 500 to about 1,000 volts per inch. Crude oil temperature ranges 220° F. to about 300° F., and residence times range from about 1 to about 120 minutes, preferably from about 1 to about 15 minutes.

Mixing of the crude oil containing chemical demulsifier formulation and wash water can be conventional ("static") or opposed-flow, and can occur in the same vessel as electrostatic demulsifier.

In opposed-flow mixing, two or more counter-currents of crude oil containing demulsifier formulation impact and intermingle with wash water. Opposed propeller (or impeller) and opposed jet (or nozzle) configurations are non-limiting examples of opposed-flow mixing. In the opposed-propeller geometry, at least two counter-rotating propellers are immersed in the crude oil-brine mixture in order to form opposed streams within the mixture. The streams of the mixture impact and intermingle in the volume between the propellers. The propellers may be in close proximity in the same reservoir or vessel, in different regions of the same vessel, or in connected vessels or reservoirs with baffles or pipes providing conducting means for directing the streams to a region where opposed-flow mixing can occur. Parameters such as propeller spacing, propeller angular speed, and the nature of any conducting means may be determined by those skilled in the art of mixing from mixture properties such as viscosity and the desired mixing energy.

In the opposed jet geometry, the crude oil containing demulsifer formulation and wash water are separated into at least two streams. Conducting can be carried out, for example, using pipes to direct the streams into an opposed-flow configuration. Accordingly, the longitudinal axes (the axes in the direction of flow) and the outlets of the pipes are oriented so that the streams impact and intermix in a region between the outlets. Preferably, two opposed pipes are employed and the angle subtended by the longitudinal axes of the pipes is about 180° . The outlets may be in the form of nozzles or jets. As in the opposed propeller geometry, parameters such as the surface area of the conduits, the flow rate of the mixture in the conduits, the size and shape of any nozzle or jet employed, and the distance between the outlets may be determined by those skilled in the art of mixing from mixture properties such as mixture viscosity and the desired mixing energy.

Mixing energy rates (mixing power) ranges from about 0.1 hp per 1000 gallons of the mixture of crude oil emulsion and chemical demulsifier to about 3 hp per 1000 gallons, with about 0.2 hp per 1000 gallons to about 0.5 hp per 1000 gallons being the preferred range. The invention can be practiced when the mixture's temperature ranges from about 20 to 150° C. Preferably, mixture temperature ranges from about 80° C. to about 130° C. The amount of added wash water ranges from about 0.5 to about 8.0 vol. % water based on the total volume of the crude oil, preferably from about 0.5 to about 3.0 vol. %.

EXAMPLES

Table 1 contains structural information on 25 additives synthesized in the laboratory having the general structure $R—Ar—SO_3H$ and are useful as demulsifier additives. The synthesis involved alkylation of an aromatic ring, followed by sulfonation. The variables in the synthesis are the type of aromatic and the type of olefin used for alkylation. Alpha olefins give a single tail while internal olefins give two tails with a distribution of splits of the total chain length between the two tails. In addition, the total number of carbons and the degree of branching of the olefins were varied. $^{13}C$ NMR was used to measure the chain length, methyl branches per molecule, percent of olefin sample that was olefin, and the percent of aromatics that was functionalized by the addition of an olefin. Elemental analysis was used to determine the percent sulfonation.

TABLE 1

| | Aromatic | Olefin Internal or Alpha | Carbon Chain Length | Methyls per Molecule | Function-alization |
|---|---|---|---|---|---|
| 1 | Toluene | Internal | 23 | 0.15 | 119 |
| 2 | Toluene | Internal | 23 | 0.15 | 78 |
| 3 | Toluene | Alpha | 21 | 0 | 76 |
| 4 | Toluene | Internal | 20–24 | 0.33 | 78 |
| 5 | Toluene | Internal | 25 | 0 | 36 |
| 6 | Toluene | Internal | 33 | 0.99 | 37 |
| 7 | Naphthalene | Internal | 37 | 0.33 | 29 |
| 8 | Naphthalene | Internal | 37 | 0.33 | 114 |
| 9 | Naphthalene | Internal | 33 | 0.99 | 44 |
| 10 | Naphthalene | Internal | 47 | 0.28 | 85 |
| 11 | Naphthalene | Internal | 37 | 0.54 | 90 |
| 12 | Naphthalene | Internal | 25 | 1.9 | 51 |
| 13 | Naphthalene | Internal | 18 | 0.10 | 95 |
| 14 | Naphthalene | Internal | 23 | 0.15 | 89 |
| 15 | Naphthalene | Internal | 18 | 0.17 | 65 |
| 16 | Naphthalene | Alpha | 21 | 0 | 86 |
| 17 | Naphthalene | Internal | 29 | 0.33 | 60 |
| 18 | Naphthalene | Alpha | 17 | 0.04 | 40 |
| 19 | Tetralin[1] | Internal | 37 | 0.33 | 76 |
| 20 | Tetralin[1] | Internal | 23 | 0.15 | 103 |
| 21 | Binaphthyl | Internal | 23 | 0.15 | 119 |
| 22 | Phenanthrene | Internal | 23 | 0.15 | 62 |
| 23 | Phenanthrene | Alpha | 21 | 0 | 34 |
| 24 | Phenanthrene | Internal | 37 | 0.33 | 43 |
| 25 | Phenanthrene | Internal | 33 | 0.99 | 62 |

[1]Tetrahydronaphthalene, trademark of E. I. Du Pont de Nemours & Company.

In order to demonstrate demulsification performance, the following demulsification experiments were conducted. A demulsifier formulation having 50% of demulsifier additive indicated in row #1 of Table-1 and 50% diethylene glycol mono butyl ether was prepared and used in the following experiments.

Experiment-1

A 1/9 brine-in-oil emulsion was prepared using 90 g of 5:1 n-hexadecane:toluene with 0.01M n-heptane insoluble asphaltene from a Venezuelaen crude oil (Hamaca oil) as model oil. To 90 g of oil were added 10 g of synthetic Hamaca brine in small aliquots with mixing on a Silverson mixer at 500 ppm. The prepared emulsion was divided into two batches. To one batch (Sample #2) was added 100 ppm of the demulsifier formulation and the other batch (Sample #1) was the untreated control. Both samples were centrifuged at 1000 ppm for tem minutes at room temperature in a graduated centrifuge tube. The amount of Brine that separated out at the bottom of the graduated centrifuge tube was noted. The % demulsification was calculated from the ratio of the amount separated to the amount initially dispersed into the crude oil sample.

In sample #1, untreated control 20% demulsification was observed whereas, in Sample #2, demulsifier treated sample 99% or almost complete demulsification was observed.

Experiment-2

A 1/9 Kome brine—in—Kome crude oil emulsion was prepared by the same procedure described in experiment-1. The prepared emulsion was divided into two batches. To one batch was added 100 ppm of demulsifier formulation and the other batch was the untreated control. Both samples were subjected to electrostatic demulsification using a Inter AV Inc Electrostatic Demulsifier Unit at 3000V for 30 minutes. A graduated demulsifier tube was used and the amount of brine separating out was noted. The % demulsification was calculated from the ratio of the amount separated to the amount initially dispersed into the crude oil sample.

For the demulsifier treated crude oil emulsion 80% demulsification was observed. For untreated crude oil 47% demulsification was observed. The crude oil phase of both samples were viewed under a microscope to determine the size of brine droplets after electrostatic treatment. The batch treated with the demulsifier formulation showed bigger brine droplets compared to the untreated batch providing evidence for efficient coalescence & demulsification performance by the demulsifier formulation.

What is claimed is:

1. A crude oil demulsifier composition comprising:

about 10 wt. % to about 80 wt. % based on the weight of the chemical demulsifier formulation of an additive having the formula:

$$R—Ar—SO_3H$$

where R is an alkyl group containing at least 16 carbons and at least one branch of an alkyl group, Ar is an aromatic group containing at least two 6 carbon-ring aromatic groups and about 90 wt. % to about 20 wt. % based on the weight of the chemical demulsifier formulation of a co-additive selected from the group consisting of dipropylene monobutyl ether, isoparaffinic solvent, cycloparaffinic solvent, diethylene glycol monobutyl ether, benzyl alcohol, and mixtures thereof.

2. The formulation of claim 1 wherein said aromatic group of the additive is fused aromatic rings.

3. The formulation of claim 1 wherein said aromatic group of the additive is non-fused aromatic rings attached to each other by a carbon-carbon single bond.

4. The composition of claim 1 wherein said alkyl group of at least 30 carbon atoms is a two branched alkyl group on a linear carbon chain.

5. The composition of claim 4 wherein each branch of said alkyl group consists of at least one alkyl branch for every 20 carbon atoms.

6. The composition of claim 4 wherein each branch of said alkyl group consists of at least one alkyl branch for every 12 carbon atoms.

7. The formulation of claim 5 or 6 wherein said alkyl branch is a methyl group.

8. The formulation of claim 1 wherein the —$SO_3H$ group of the additive is attached to any carbon on the aromatic group of the additive.

* * * * *